United States Patent [19]

Volpe et al.

[11] Patent Number: 4,877,292

[45] Date of Patent: Oct. 31, 1989

[54] IMPROVED UNITARY DISPOSABLE CHAIR WITH COMFORT-CONTOURED INNER REINFORCEMENT

[76] Inventors: James R. Volpe, 2710 S. San Pedro St., Los Angeles, Calif. 90011; James L. Kelley, 22461 St. Andrews Ave., Cupertino, Calif. 95014

[21] Appl. No.: 106,055

[22] Filed: Oct. 7, 1987

Related U.S. Application Data

[63] Continuation-in-part of Ser. No. 947,645, Dec. 30, 1986, Pat. No. 4,811,987.

[51] Int. Cl.[4] ..... A47C 4/00

[52] U.S. Cl. ..... 297/440; 297/16; 248/174

[58] Field of Search ..... 297/16, 440, 442; 248/152, 174; 206/44 R, 216, 326

[56] References Cited

U.S. PATENT DOCUMENTS

| | | | |
|---|---|---|---|
| 1,896,721 | 2/1933 | Richards | 248/174 X |
| 1,916,647 | 7/1933 | Walker | 248/174 |
| 2,041,751 | 5/1936 | Folsom et al. | 248/174 |
| 2,049,659 | 8/1936 | Parrott | 297/16 |
| 2,586,886 | 2/1952 | Tyrseek | 206/180 X |
| 2,727,619 | 12/1955 | Paige | 206/44 R |
| 3,331,634 | 7/1967 | Harrison, Jr. | 297/447 |
| 3,334,732 | 8/1967 | Haffey et al. | 206/44 R |
| 3,606,459 | 9/1971 | Krone | 297/440 |
| 4,648,658 | 3/1987 | Calco | 297/440 |

*Primary Examiner*—Peter R. Brown
*Attorney, Agent, or Firm*—Ashen Golant Martin & Seldon

[57] ABSTRACT

This chair folds flat for storage and shipment, or unfolds and sets up for use, in only a few (e.g., three to five) seconds. Even though it is strong and stable, the chair can be made from one simple blank of five rectangular panels, two smaller panels and a glue tab, using only two glue joints. Its lower part, a rectangular glued tube, has a vertical seat-support panel across the inside, parallel to two of the outer walls—so the support panel, though preglued in place, folds and unfolds with the tube. The upper part of the chair is an extension of the tube, but the front panel folds inward, backward, and downward to form a seat that spans the tube, supported by the front and seat-support panels. Refinements in support-panel detail facilitate assembly and disassembly while enhancing both support of the seat and controlled deformation of the seat and support for best comfort. The upper part of each side also folds inward and downward, but only above a diagonal fold from the upper rear corner of the chair downward and forward to meet the fold line of the front-and-seat panel. The sides double over along this diagonal fold, so the seat is in effect hung from the diagonal folds, receiving slight additional support. The back is scored to allow deformation of the tube in a buckling mode, for added comfort.

19 Claims, 6 Drawing Sheets

IMPROVED UNITARY DISPOSABLE CHAIR WITH COMFORT-CONTOURED INNER REINFORCEMENT

BACKGROUND

Related Application

This is a continuation-in-part of our application Ser. No. 947,645, filed Dec. 30, 1986, and now U.S. Pat. No. 4,811,987.

Field of the Invention

This invention relates generally to economical, easily transported and rapidly set up chairs suitable for large gatherings such as parades, sporting events and parties; and more particularly to a collapsible, disposable chair of corrugated fiberboard or like generally planar recyclable material.

Prior Art

Many efforts have been made to provide a satisfactory chair that can be formed from corrugated cardboard or like internally-reinforced sheet stock, to take advantage of the low cost, weight and bulk of the material -- as well as its inherent (but nonisotropic) compressive and tensile strength. Such efforts, while successful conceptually, generally have foundered commercially on the difficulty of simultaneously satisfying two conflicting conditions.

One one hand, corrugated fiberboard is weak with respect to bending or folding along the "grain" (i.e., the direction of the fluting). A practical design must provide enough bracing to overcome this inherent weakness.

On the other hand, a practical design—particularly in the current era of high labor cost—must be simple enough to absolutely minimize handwork. Manual fabrication or assembly operations rapidly run up the overall cost of manufacture or use. The same is true even of disassembly operations, for fiberboard chairs usually must be knocked down preparatory to reuse or even to economic disposal.

Prior-art fiberboard chairs are disclosed in literally dozens of United States patents. Of these, a representative pertinent sample includes U.S. Pat. Nos. 2,049,659, 2,806,514, 3,168,347, 3,312,503, 3,250,570, 3,331,634, 3,463,546 and 4,085,970.

As can be seen at a glance, all these designs involve multiple compound folds and contours, tab-and-slot attachments, mutually slotted cross-brace inserts, and other elaborations. Some of these complex designs may be viable for small-volume applications such as children's furniture, in which a few minutes of assembly work (usually assigned to the retail consumer) may be commercially acceptable.

For high-volume applications such as parade or ball-game seating, however, in present economic terms such designs are entirely unacceptable. In each case the care and time required for assembly, disassembly or both renders the design impractical.

One prior configuration that is commercially and industrially much more sophisticated appears in U.S. Pat. No. 4,556,253, issued Dec. 3, 1985, to Geneve et al. The base of this chair is a glued tube of irregular form -- apparently a nonequilateral hexagon. The seat, rather elaborately contoured and shaped, has double thickness.

Geneve and his coinventors have apparently gone to some length to produce a fiberboard chair that has the look of comfortable furniture and may actually be ergonomically sound. Nevertheless their finished chair is all one piece, collapses flat for storage and transport, and can be made from a single die-cut and scored blank.

Thus U.S. Pat. No. 4,556,253 represents quite an accomplishment. It is a clear and plainly useful advance over the prior art, but it does leave some areas for improvement.

First, the Geneve chair requires a relatively elaborate blank. As can be seen from Geneve's FIGS. 2*a* and 2*b* (which show the chair in its folded-flat condition), he uses double-thickness seat and backrest panels, and "optional" reinforcing panels A, B, C, A', B' and C'.

Although Geneve characterizes the six panels just mentioned as "optional," he also indicates that he "prefers" to provide them to obtain satisfactory strength of the finished chair when using general industrial-grade fiberboard. It appears fair to infer that the broad, open and irregular plan of the chair base naturally results in some considerable structural weakness, which is best compensated by providing the reinforcing panels at the bottom edges -- and by providing the double seat and backrest panels.

Secondly, because of its complicated shape, the chair requires relatively extensive machine (or personnel) time for initial preassembly. Special attention is required for gluing or other securing of at least three parts of Geneve's chair: (1) the irregularly shaped, irregularly angled friction and slot-engagement panels G, H and I; (2) the "optional" reinforcement panels A, B, C, A', B' and C'; and (3) the tube-completion tab M (FIGS. 1 and 2*a*).

The tab M is particularly troublesome, though it appears innocuous in Geneve's drawings, for it must be folded back on itself at 180 degrees in preparation for gluing. Stable, reliable machine gripping of such a tab for gluing requires a much wider tab than Geneve's drawings suggest.

Correction of this problem by widening the tab, however, tends to increase material use excessively. This is particularly important in view of the waste material that extends to the full height of the blank, above the tab M.

Moreover, setting up automatic machinery for a reliable grip is especially tricky, even if the tab M is wider, because the tab M extends less than the full height of the chair blank. Hence the Geneve design leads inevitably to a "fussy" adjustment of the machine, or as it might be called in the industry, a "touchy run."

Experienced fiberboard fabricators know that such special projects carry a very dangerous potential for delaying—and consequently losing—the profitable projects of their regular customers. The latter are typically long machine runs on a short schedule, manufacturing conventional boxes and the like.

Seasoned operators in the fiberboard production field thus are wary of tying up their facilities with projects requiring special attention. They are reluctant to accept such jobs, even with price premiums for the extra work. A machine operation such as assembling the Geneve chair, as a practical matter in the industry, may be simply refused.

Even if performed manually, the gluing of Geneve's tab M is difficult. The tab must be folded to its 180-degree folded-back position, and then held and glued simultaneously. The economic impact of such design details on practical implementation of an invention cannot be overemphasized.

Thirdly, the Geneve chair is relatively bulky to store and ship, even in its folded-flat condition. This is due to the fact that in that condition the seat and backrest panels extend upward well beyond the top of the chair back. In particular, the narrow rib or webbing BB (FIG. 1) defines the maximum height of the chair back, but the seat and backrest panels K, N, 0, P, Q and R apparently extend a foot or more past that webbing.

Fourthly, even putting aside manufacturing, preassembly and handling costs, it may be difficult in practice to realize the theoretical economics of the Geneve chair. Here the sticking point may be in the very sophistication that confers upon the chair its various advantages.

Specifically, the Geneve chair is apparently quite tricky to set up. The reason, again, is clear from examination of FIGS. 2*a* and 2*b*.

As those drawings show, the fold lines that separate the six walls of the chair base do not extend upward into the seat and back panels. Therefore, notwithstanding Geneve's text at columns 7 and 8, one cannot simply open out the base portion to its hexagonal form without simultaneously folding the seat panels down.

To properly accomplish those two tasks simultaneously, however, would appear to require considerable dexterity and practice.

Furthermore, it is necessary to open the base to the correct hexagonal plan, to match the descending seat panels. Upon reflection, and without intending in the least any disrespect, it will be realized that establishing a correct mental model of an irregular hexagon may be asking a great deal of the type of personnel who may normally be engaged to set up cardboard chairs along a parade route.

In sum, it is not at all clear that unskilled or semiskilled laborers could quickly learn to set up a large number of such chairs in a hurry. Yet economics obviously militate against damaging an unduly large fraction of the inventory during setup. Even well-practiced personnel would surely require five or ten seconds, at the very least, per chair.

The foregoing comments are believed to be valid even without taking into consideration the required engagement of Geneve's locking tab Z with its mating slot Z' for assembly – and disengagement of those elements for disassembly. These tabs and their mating slots, besides taking time to engage or disengage, will shortly become worn and then damaged, severely limiting the reusability of the chair.

The same appears true, though perhaps to a lesser degree, of the notches Y and mating notches Y' (FIGS. 1, 8 and 10). These notches must be meshed at each assembly, and unmeshed at each disassembly, of the Geneve chair.

Another prior patent that may be pertinent to our invention since it discloses a chair-shaped fiberboard display shelf, although it is not a chair at all, is U.S. Pat. No. 4,279,375. That patent issued July 21, 1981, to Gardner and is assigned to Container Corporation of America.

The Gardner patent is actually in a different field, namely that of retail-goods display paraphernalia. More particularly, Gardner discloses a combination shipping carton and display shelf.

As is best shown in Gardner's FIGS. 1 and 2, his invention is a glued rectangular tube (note glue tab 16) that has a horizontal score 35 across the front panel 40, 10. It also has on each side a diagonal score 39 running from the upper rear corner of the tube downward to meet the horizontal front score 35 at the front corner of the Gardner tube.

As best shown in Gardner's FIGS. 6 and 7, the upper portion 46-44-42-40 of the front panel 10-46-44-42-40 can be folded backward, downward and inward, relative to the tube, to form a flat shelf. The forward upper triangular corner 48-50 of each side wall simultaneously is doubled over along the scores 39, to lie flat against the remaining part 12 of the side wall, but inside the tube.

As a result the flat shelf 46-44-42-40 is hung at its lateral edges (previously the vertical corners 29, FIG. 1) by the triangular panels 48–50, from the fold lines 39. By selection of a forty-five-degree angle for the fold lines 39, Gardner causes the rear edge of his shelf to just touch the inside of his rear panel.

To permit the front panel to fold inward as described, it is necessary to account for so-called "lost motion" that occurs only during the folding. That is to say, the upper portions of the panels must be temporarily deformed out of their rectangular-tube plan. To permit this buckling, best shown in Gardner's FIG. 6, he has provided additional diagonal scores 37 in the upper portion 46-44-42-40 of his front panel.

Such additional scores clearly weaken the shelf. Since it is used only for merchandise, however, any such weakening may be immaterial.

Both Geneve and Gardner disclose vertical glued-tube constructions, and such constructions generally are known. Neither Geneve, nor Gardner, however, provides any direct support in the nature of an internal pillar or pedestal beneath the support surface—that is, beneath Geneve's seat panel or Gardner's display-shelf panel—for the weight to be disposed upon that support surface.

Various prior-art chairs mentioned in the patents enumerated earlier do provide internal pillars, but there is no suggestion in any of the patents discussed so far of any way to provide such an internal pillar without destroying the flat-knockdown feature of the Geneve chair – or for that matter the general utility of the Gardner invention as an open-construction shipping carton.

Even more emphatically lacking, from those patents that do illustrate internal pillars for support and stiffening of seats, is any teaching of ways to "fine tune" or moderate the stiffening action. Thus there is no enabling disclosure of any sort of controlled deformation of a seat structure that could provide optimum comfort for users.

Yet another teaching of prior art that may be pertinent to our invention is also in the field of shipping containers, although it is not discussed, disclosed or even suggested by Gardner. That teaching consists of supplying an internal crosswise panel for a vertical rectangular glued tube, parallel to two of the walls of the tube – the so-called "bridge box" construction.

The internal panel is often glued or otherwise secured in position. Its primary purpose is to divide products contained in the box and to add stacking strength.

As the internal vertical panel parallels the external walls of the glued tube, it need not be removed to fold the tube for shipment, etc. Rather, the inside panel folds down in parallelogram fashion, along with the tube itself.

We are not aware of any prior-art suggestion that the three groups of teachings described above might in any way be combined. Gardner's combined display rack and shipping carton is neither in need of nor compatible with an added inside panel. (In addition, his shelf is weakened by diagonal scores; these factors together leave his configuration entirely inadequate for seating applications.) Geneve's chair design, considering the hexagonal plan and nonhorizontal seat, does not appear to allow installation of a parallelogram-style inside panel; and as earlier noted his invention is already excessively elaborate and "touchy" to fabricate.

In addition to the patents just discussed, other art has been introduced in the prosecution of our earlier patent application identified above. In the public history of prosecution of that application there is to be found a discussion of the relation of that art to the subject matter of our inventions generally. We believe that nothing therein diminishes the accuracy of statements in this document as to the inadequacy of the prior art.

Thus the prior art fails to satisfy the commercial need for a chair that can be made and assembled very economically at high volume from fiberboard or the like, to take advantage of the favorable properties of such material while providing adequate strength.

SUMMARY OF THE DISCLOSURE

Our invention is a disposable chair, though it may be reused many times if desired. In only a few seconds—as few as two or three seconds—our invention, if already set up for use as a chair, can be folded flat for storage and shipment; or if in that latter condition can be unfolded and configured for use.

The chair includes four contiguous and rectangular panels. The panels should be of material that is of generally planar character.

By that we mean that the material is extended in only two dimensions and very thin in a third dimension. Thus it may alternatively be called "sheet material." The material should, however, be sufficiently stiff and strong in the aggregate, when configured for use, to support a person.

The four rectangular panels define generally vertical edges of equal length. That length is the overall height of the chair.

One pair of the four rectangular panels is mutually of equal width. That width is the width of the chair when in use.

One panel of this particular pair forms the back of the chair. The other panel of this pair has portions that respectively form the front and seat of the chair.

Another pair of the four rectangular panels is mutually of equal width, which width is the front-to-back depth of the chair when it is in use. Each panel of this other pair forms one of the sides of the chair.

These four rectangular panels are joined along the entire lengths of their equal-length edges. The side panels alternate with the front and back panels, to form a continuous four-panel row. The opposite ends of this four-panel row, in turn, can be joined to form a continuous upstanding tube of rectangular plan.

A fifth rectangular panel is disposed erect within the tube, and defines two vertical edges and a horizontal upper edge. This panel is joined along its two vertical edges to one or the other of the two pairs of rectangular panels previously mentioned; and it is parallel, and nearly equal in width, to the remaining pair of rectangular panels.

The fifth panel, like the others, is of generally planar material -- but sufficiently stiff and strong to significantly aid in supporting, and in distributing to the other four panels for support thereby, the weight of a person.

The seat-forming portion of the panel that forms the front and seat of the chair is folded downwardly and inwardly, with respect to the tube, against the back of the chair. In that position it is supported by the horizontal upper edge of the fifth panel.

Each side panel is doubled over and inwardly, with respect to the tube. This folding-over of each side panel is along a line extending generally from the top rear corner of the chair downward and forward to intersect the transverse fold in the panel that forms the front and seat.

In addition, upper portions of the side panels are scored—or otherwise adapted for folding—along additional intermediate angled lines. These additional fold lines are provided to permit temporary buckling deformation of upper portions of the tube out of rectangular plan.

It may be noted that there is no intermediate fold line in the seat-forming portion. Here we depart from any possibly pertinent teaching of Gardner, whose shelf 46-44-42-40 as mentioned earlier is weakened by its diagonal scores 37.

Such deformation is useful to facilitate the folding of the seat-forming portion downward and inward relative to the tube for use. Conversely, the same deformation comes into play in unfolding of the seat-forming portion upward and outward, relative to the tube, preparatory to flattening the entire structure for shipment and storage.

The foregoing may be a description of our invention in its broadest or most general form. There are several features, however, which we consider highly desirable and prefer to incorporate into the structure for enhancement of the advantageous performance of our invention.

One such preferred feature is that the fifth panel satisfy certain conditions. In particular, we prefer that the height of the fifth panel generally defines the height of the chair seat, and that that height generally equals the difference between the overall height of the chair and the front-to-back depth of the chair. The reason for this condition upon the height of the fifth panel will be explained in the detailed description that follows.

Another preferred feature is an intermediate, generally planar vertical strip interconnecting one of the two vertical edges of the fifth panel with a vertical edge of one of the other four panels. This strip stands parallel to and in generally planar contact with some one of the other four panels, and is of a width that is very generally half the width or depth of the chair.

The principal function of this intermediate strip is to interconnect the fifth panel with a corner edge of the continuous row of panels that forms the tube. The interconnection makes it possible for the fifth panel to be part of the same unitary blank of material that is used to make the rectangular tube.

Another preferred feature is a generally vertical tab, unitary with the other of the two vertical edges of the fifth panel. This vertical tab secures that "other" vertical edge to a rectangular panel which is opposite the intermediate strip. In this way the fifth panel can be positioned parallel to either the front and back panels, or to the side panels, of the rectangular-plan tube.

We also prefer to provide the fifth panel with an extension panel, which is folded at ninety degrees—just below the seat—to a horizontal orientation. The fold itself functions to very greatly stiffen the fifth panel; hence the extension panel may instead be called a "stiffening-angle tab." In this case the fold line may be regarded as the previously mentioned "horizontal upper edge" of the fifth panel, since the seat is supported on this fold line.

All of the five panels, and the intermediate strip and the vertical tab as well, can thus be formed of a single unitary blank. One of the four first-mentioned rectangular panels is at one end of the blank, and the tab is at the other end of the blank.

The panel that is at one end of the blank is secured to the intermediate strip, as a convenient arrangement for completing the continuity of the tube.

Yet another preferred feature of our invention is that all of the five panels have cut horizontal bottom edges, defined by a continuous and colinear cut edge of the blank, for resting directly on pavement or grass or like supporting surface. As the geometry of our invention provides extreme strength and stability, there is no need for upfolded bottom reinforcement panels such as those of the Geneve et al. chair.

Although our chair might possibly be made with "buckle" lines in the seat panel analogous to those in Gardner's display shelf, we prefer to avoid weakening the seat panel in that way. We have found that deformation to accommodate lost motion may be accomplished very adequately by providing the angled fold lines in the side of the chair.

We also prefer to provide fold lines in the back of the chair, though not for lost motion. This feature somewhat enhances comfort by allowing the back of the chair to conform slightly to that of the person occupying the chair.

Another preferred feature of our invention is a hand-access cutout in the top of the front panel. This cutout becomes a hand-access slot at the rear of the seat panel, when the seat is in position for sitting, and facilitates folding the seat panel up and out preparatory to folding the overall tube flat for shipment or disposal.

Another particularly important group of features of our invention is in the nature of detailed refinements to the stiffening-angle tab already mentioned. We have found that by introducing these refinements it is possible to make assembly and disassembly even easier.

Most significantly, these refinements also permit a controlled deformation of the seat panel and stiffening-angle tab, when the seat panel and the tab have been folded to their generally horizontal positions. This deformation of the seat panel and the stiffening-angle tab permit the support surface of the seat to conform to a user's body.

The refinements which provide these advantages include (1) a lengthening of the stiffening-angle tab itself so that when folded down it contacts the rear panel of the chair, (2) addition of a notch at the extreme edge of the panel, and (3) adding a through-cut to the panel, parallel to but offset slightly below the folding score.

The lengthening of the stiffening tab increases a user's leverage in folding down the tab. A user can insert fingers into the notch, to grasp and raise both the seat panel and the tab at once for disassembly.

The through-cut converts a shallow part of the fifth panel from being part of the vertical-support column to being a part of the horizontal tab. The result is to moderate the stiffening action of the tab, and at the same time to create a shallow depression—in effect a cavity below the horizontal tab—in the upper end of the vertical column.

These two effects in turn permit a slight sagging of the seat panel into the cavity in the top of the vertical part of the reinforcement panel. This slight controlled sag very greatly enhances the user's comfort, particularly in protracted use.

At the same time a useful fraction of the stiffening action of the tab is retained, so that the structural advantages of the fifth panel and its stiffening tab are maintained. By extensive trial and error we have learned how to dimension the offset cut to optimize the tradeoff between stabilization of the structure and enhancement of the user's comfort, and we do not in the slightest sacrifice the economy, ease of manufacture, compactness, or any other beneficial property of our invention.

Our invention, as defined by the appended claims, also encompasses the novel blank for making the chair.

It also encompasses methods for using the chair. One such method is for reusing or disposing of the chair; it includes the following steps:

(1) providing the chair configured for use in supporting a person on the seat-forming portion;

(2) after such use is completed and a person no longer occupies the chair, inserting a hand from above through the hand-access cutout of the seat-forming portion;

(3) then grasping the seat-forming portion (and also the stiffening-angle tab, if present) through the cutout, and lifting it away from the back of the chair;

(4) generally simultaneously with the grasping and lifting step, deforming the upper portions of the four first-mentioned rectangular panels by buckling the sides outward, relative to the tube;

(5) continuing the motion of the seat-forming portion (and the stiffening tab, if present) upward and forward until the seat-forming portion is generally vertical;

(6) then folding the tube from its rectangular plan condition to its generally flat condition; and;

(7) then shipping the folded chair as a flat tube to a subsequent point of use or storage.

Another method within the scope of our invention is the converse method for placing the chair in use. It includes these steps:

(1) shipping the folded and secured blank as a flat tube to a point of use;

(2) then unfolding the tube to its rectangular plan condition;

(3) then deforming the upper portions of the four first-mentioned rectangular panels by buckling the sides at the intermediate angled lines outward, relative to the tube:

(4) then pushing the seat-forming portion backward, inward relative to the tube, and downward against the back, to be supported by the upper edge of the fifth panel;

(4*a*) either before or during the deforming and pushing steps, pushing the stiffening-angle tab (if it is present) backward, inward relative to the tube, and downward toward generally horizontal orientation; and (5) then providing the chair for use in supporting a person on the seat-forming portion thereof.

As will now be clear, our invention provides a very light but strong, reinforced disposable (or reusable) chair that may be made of corrugated fiberboard very inexpensively, with negligible waste. It requires extremely little preliminary assembly -- and even that can all be performed by very simple machine operations.

The chair takes a very minimum of space for shipment and storage, and only a very few seconds of unskilled labor for setup or knockdown. It has not even one assembly tab to slow either task -- or to wear or be damaged.

The principles and advantages of our invention will be more fully appreciated upon consideration of the following details, with reference to the appended drawings, of which:

DETAILED DESCRIPTION OF THE PREFERRED EMBODIMENTS

Figure 2:
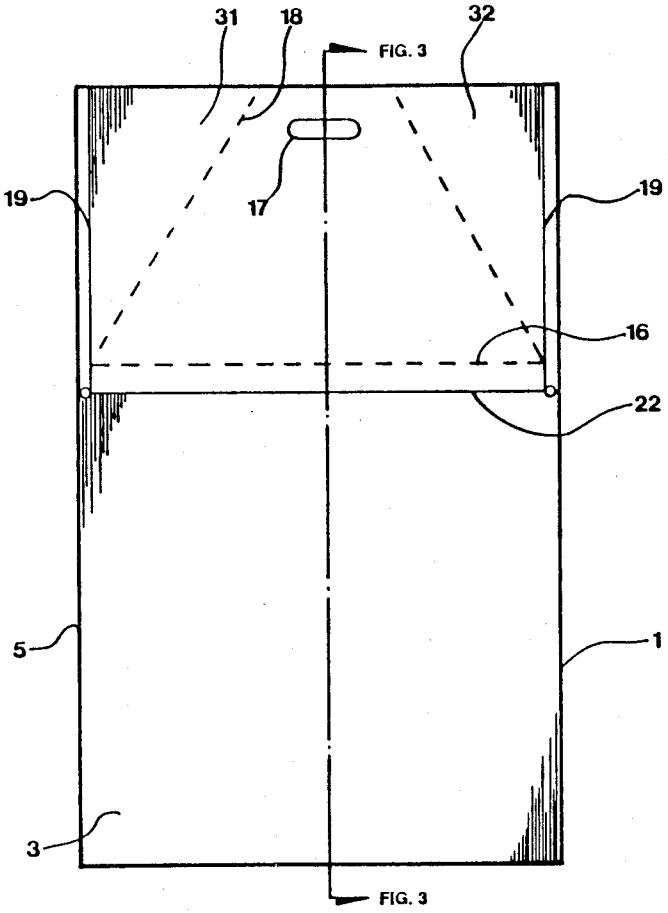
FIG. 2 is a front elevation of the same embodiment.
Figure 1:
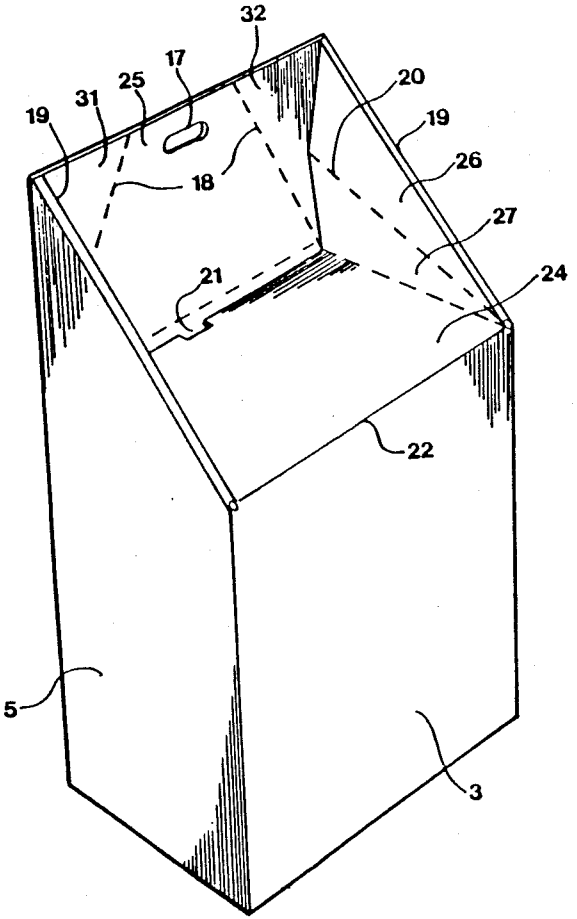
FIG. 1 is an isometric drawing of a preferred embodiment of our invention, shown configured for use in supporting a person.
Figure 3:
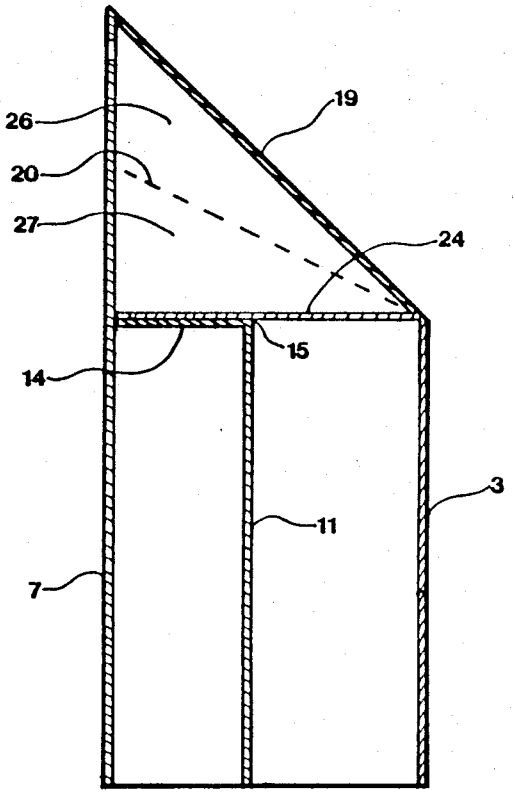
FIG. 3 is a side elevation, in section, of the same embodiment -- taken in a plane that is just inside either side wall.

As shown in FIGS. 1 through 3, a preferred form of our invention when set up for use is a chair with a generally horizontal rectangular seat panel 24, and generally vertical rectangular front and rear panels 3 and 7-25-31-32 respectively. The chair also has generally vertical trapezoidal left and right side panels 1 and 5 respectively. (All references to lateral direction in this description are as viewed from in front of the chair.)

These are the four rectangular panels first-mentioned in the brief description above.

The upper portions of the sides of the chair (the portions above the seat 24) are double walled, having inner side panels 29–30 on the left side and 26–27 on the right. These inner side panels 29–30 and 26–27 are continuous with the outer side panels 5 and 1 respectively, being folded over at double folds 19, and they suspend the seat 24.

As shown in FIG. 3, the seat also rests upon an internal cross-panel 11 (the "fifth panel" mentioned earlier, which is stabilized by a right-angle fold 15 at the base of its extension panel or stiffening-angle tab 14. Thus the seat is triply supported -- in compression by the front panel 3 and internal panel 11, and in tension by the inner side panels 29–30.

It will be appreciated that the major part of the weight of a person occupying the seat typically will be borne by the internal cross-panel 11. The front panel 3 typically bears the next largest fraction of the weight.

The tension effect of the inner side panels 29–30 in suspending the seat 24 normally comes into play only if the occupant enters the seat in such a way as to slightly damage the internal cross-panel 11 or to slightly disrupt the stiffening effect provided by the right-angle fold 15 -- or if the occupant sits in the seat in a skewed fashion that tends to slightly lift the seat away from the internal cross-panel 11.

The chair has a handhole 17 for convenience in carrying. It also has a hand-access slot 21 for use in preparing the chair for shipment, storage, or disposal as will be explained shortly.

In the rear panel, the upper portions 25-31-32 of the erected chair are generally coplanar with the lower portion 7, and the same is true of these portions even when the chair is folded flat for shipment, storage or disposal. Nevertheless, the upper portions 25-31-32 are separated from the lower portion 7 by a horizontal fold line 16; and the upper central portion 25 is separated from the upper side portions 31 and 32 by diagonal fold lines 18.

Similarly the inner side wall upper portions 26 and 30 are separated from the corresponding generally coplanar lower portions 27 and 29 by intermediate diagonal fold lines 20. All these fold lines are provided for purposes to be made clear below.

Figure 4:
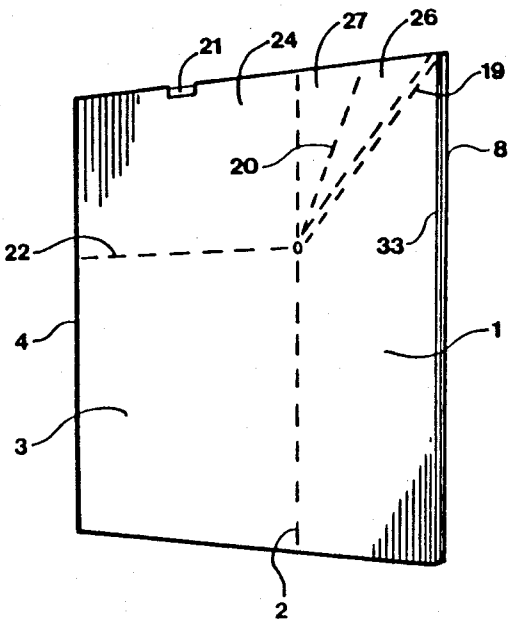
FIG. 4 is a perspective drawing of the same embodiment folded flat for storage or shipment (or disposal), but stood up on as if just removed from a pallet.

The preferred form of our invention can also assume the flattened or "closed" configuration of FIG. 4. In this condition it is extremely compact.

More specifically, the overall thickness is only at maximum three layers of the fiberboard or other material, while the overall "height" (that is, the lengths of the glued edges 8, 33) is only equal to the height of the back panel of the erect chair. Furthermore, the width of the flattened chair is the sum of the widths of only two panels -- e.g., front panel 3 and side panel 1, as shown.

In FIG. 4 the chair, though still in its "closed" configuration, is on edge -- as if, for example, it has just been removed from a horizontal disposition on a shipping pallet, and rotated ninety degrees onto its edge.

Figure 7:
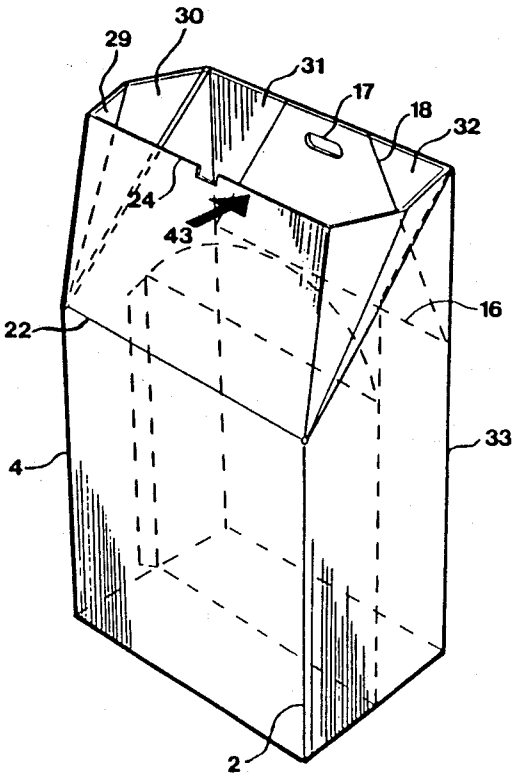
FIG. 7 is a like drawing, but taken from above, showing the same embodiment at the next intermediate stage of assembly -- with the rectangular tube still vertical and the seat now started inward.
Figure 6:
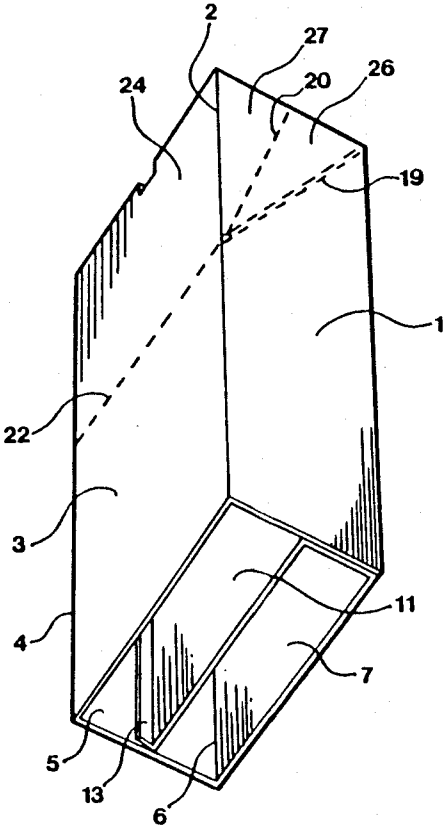
FIG. 6 a like drawing, also taken from below and showing the same embodiment at an intermediate stage of assembly -- namely, folded open to a rectangular tube, with the seat panel not yet in position for use.
Figure 5:
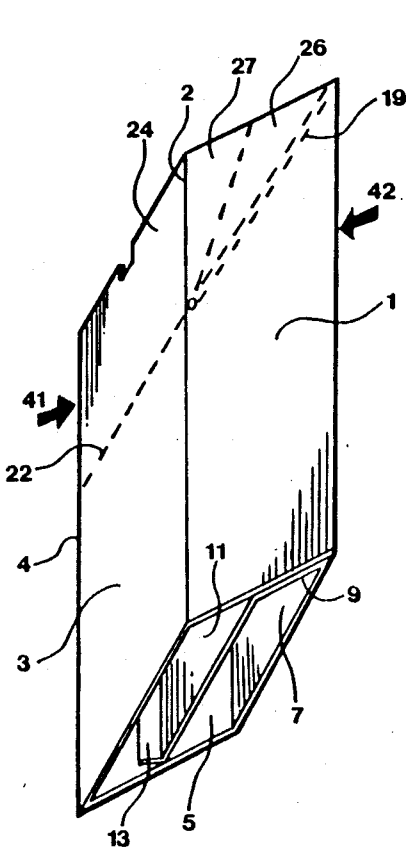
FIG. 5 is a like view, but taken from below. It shows the same embodiment, still standing on end, but now in the process of being opened from the FIG. 4 condition into a vertical rectangular-tube condition for use.

FIGS. 5 through 7 represent three configurations of the chair. These configurations are intermediate between the flattened or "closed" condition of FIG. 4 and the opened condition of FIGS. 1 through 3.

In the first intermediate configuration, the flattened or "closed" chair of FIG. 4 is still erect, but now partially unfolded, or "folded open," into a parallelogram-shaped tube.

To obtain this condition from that of FIG. 4, one first allows the natural springiness of the 180-degree folds 4 and 33 to very slightly open the tube from its completely flattened or "closed" condition, so that the bottom two panels 5 and 7 are no longer substantially coplanar -- and similarly with the top two panels.

It will be understood that this "first step" takes virtually no time at all. It occurs, without effort on the part of the person assembling the chair, as soon as the chair is placed on edge or even earlier.

Next one moves the fold line 4 that is at the left edge of the flattened or "closed" chair (as viewed in FIGS. 4 and 5) toward the right relative to the glued seam 8, 33 that is at the right edge. The latter part of this motion is indicated by the arrows 41 and 42.

As can be seen in FIG. 5, the internal "fifth panel" 11 (with its extension panel 14) is parallel to the front and back panels 3–24 and 7. Consequently the fifth panel 11, 14 folds open in parallelogram fashion along with the front and back panels 3–24 and 7. FIG. 5 also illustrates the manner of attachment of this panel 11 to the left side panel 5 by a glue tab 13 and to the right side panel by intermediate panel 9.

By continuing to unfold the parallelogram-shaped tube until the angles between adjacent panels (e.g., at the principal fold lines 2, 4 and 6 and at the glue seam 8–33) are all substantially right angles, one eventually brings the chair to the substantially rectangular-tube condition shown in FIG. 6.

The chair is now already standing on its bottom end. Next, as shown in FIG. 7 the seat panel 24 is pushed backward, inward and downward to approach the position represented in FIG. 1.

The height of the seat panel 24 above any supporting surface is of course equal to the difference between the overall height of the chair and the length of the seat panel 24 – i.e., its vertical length before it is pushed back.

Since the seat panel 24 spans the front-to-back depth of the chair, its length substantially equals the common widths of the side panels 1 and 5. (The angle of the double-fold lines 19 to the horizontal is thus forty-five degrees).

The height of the seat panel above any support surface is therefore, as previously mentioned, generally equal to the difference between the overall height of the chair and the front-to-back depth of the chair.

It will be appreciated that if the upper portions 29–30 and 26–27 of the left and right side panels 5-29-30 and 1-26-27 respectively were rigid, and if each were maintained coplanar as in FIGS. 4 through 6, it would not be physically possible to move the seat panel 24 from its FIG. 6 position to its FIG. 1 position. This is so even though, as previously mentioned, the left and right inner side panels 26–27 and 29–30 are respectively coplanar after the chair has been erected.

The reason is that the left and right edges of the seat panel 24 must pass directly adjacent to the upper diagonal double fold lines 19, but rigid upper side portions 29–30 and 26–27 would force the seat panel 24 away from the fold lines 19 in the intermediate portions of the motion. To permit lowering of the seat, the upper side-panel portions 26–27 and 29–30 are separated by respective auxiliary or intermediate fold lines 20, which allow the upper side-panel portions 26–27 and 29–30 to buckle outward as indicated in FIG. 7.

The rear panel is also provided with diagonal fold lines 18 and a horizontal fold line 16. These fold lines allow some flexing of the seat in response to application of a user's weight, to more comfortably accommodate the user's back.

It will now be seen that the entire assembly process reduces to just three simple motions: standing the tube on end, opening it to rectangular form, and pushing the seat into place. There is no slot-and-tab fitting step.

Accordingly, unskilled personnel can perform this entire final-assembly or erecting procedure in just three seconds, or perhaps as much as five seconds. Moreover they can do so after only a few minutes' training – which generally consists of being shown the procedure once.

It will be understood that there is great variability among individuals in the ability to understand and imitate a simple mechanical procedure involving "normal" manual dexterity and "typical" spatial-relations sense. Accordingly our invention is not necessarily limited or defined in terms of the amount of assembly effort or time needed by any particular individual or individuals, except to the extent (if any) specified in the appended claims.

(At various points in this document we have mentioned several figures for assembly time, and duration of training, for our invention and for the Geneve invention. We mean these primarily as comparative values to aid in appreciation of the character of our invention, and to aid in appreciating the advance represented by our invention over the prior art. We consider the recited assembly and training intervals to be representative of typical unskilled personnel.)

Furthermore, such personnel can even more rapidly refold the chair for shipment, storage and/or disposal by simply reversing the procedure just described. That is, the seat 24 and extension 14 are first folded forward and upward, and the seat 24 outward, to regain the FIG. 6 rectangular-tube structure.

The hand-access slot 21 in the seat 24 facilitates this process. This slot makes it unnecessary to reach through the chair from the bottom to start the seat 24 and extension panel 14 upward from their horizontal positions of FIGS. 1 through 3 and FIG. 9.

The rectangular structure is then simply allowed to collapse. It passes through the parallelogram condition of FIG. 5 to the flattened condition of FIG. 4.

As will be understood, the FIG. 4 starting point of the final-assembly process shown in FIGS. 4 through 7 is a structure that has already been preliminarily assembled. The preliminary steps include partial folding, securing of the tab 13 to the inside of the lower left-hand side panel 5, and securing of the inside of the right-hand side panel 1 to the intermediate panel 9.

We prefer to perform such securing by the use of glue, and preferably by automatic machinery which can fold and glue the blank to obtain the flattened form of FIG. 4. The securing may alternatively, however be effected by use of heat-sensitive or chemically sensitive construction materials, staples, or any other apt means of attachment, whether known in the art at this writing or developed later.

Figure 8:
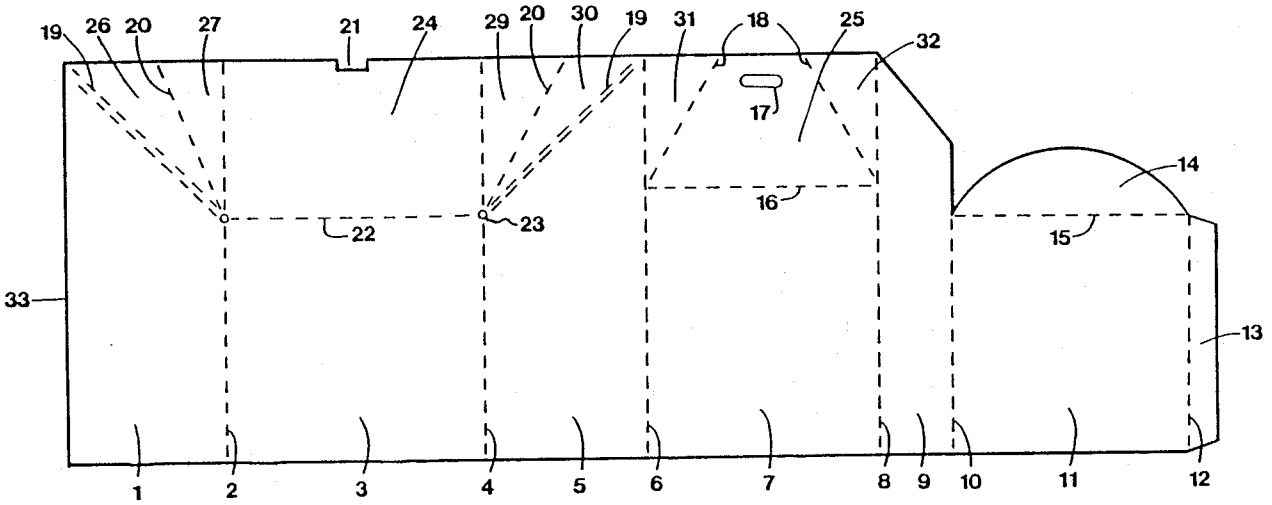
FIG. 8 is an orthographic drawing of the single unitary blank (in its initial flat condition) from which the same embodiment is assembled.
Figure 9:
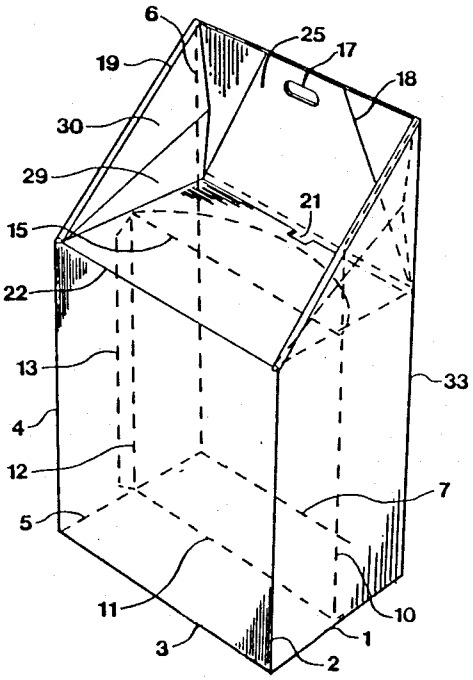
FIG. 9 is an isometric view, similar to FIG. 1, but showing the various panels as if transparent, and with the seat folded not quite fully down into position for sitting.

FIGS. 8 and 9 illustrate how the entire chair of our invention can be folded up from a single blank of sheet material. They thus implicitly show also how the flattened form of FIG. 4 of our invention can be prepared from such a blank.

The relationship between FIGS. 8 and 9 may be conceptualized as follows. In essence, the rear panel 7-25-31-32 remains in position while the other panels are folded "forward" or "upward" out of the plane of FIG. 8, and then transversely above the plane of FIG. 8 toward one another to obtain the enclosed forms of FIG. 9.

More specifically, the intermediate strip 9, the "fifth panel" 11 with its extension 14, and the glue tab (or more generally "securing tab") 13 are all folded forward in two right angles at the right-rear-corner vertical fold line 8 and the right-internal-corner vertical fold line 10. As a consequence the "fifth panel" 11 and extension 14 are parallel to and directly forward of the back panel 7-25-31-32.

The glue tab 13 is folded either in the same or (as illustrated) the opposite sense in another right angle at the left-internal-corner vertical fold line 12. Hence the glue tab 13 and intermediate strip 9 are mutually parallel, but at right angles to the rear panel 7 and "fifth panel" 11.

On the other side of the rear panel 7, the side panels 1 and 5 and the front-and-seat panel 3–24 are all folded forward in three right angles along the left-rear-corner vertical fold line 6 and the two front-corner vertical fold lines 2 and 4. One result is that the inside of the left side panel 5 meets the glue tab 13 to form a parallel joint.

Another result is that the front panel is directly in front of and parallel with both the back panel 7-25-31-32 and the "fifth panel" 11. Yet another result is that the inside of the right side panel 1 meets the intermediate strip 9 to form another parallel joint. In the latter case the far left-hand edge 33 of the blank as shown in FIG. 8 meets the right-rear corner fold 8, as shown in FIGS. 4 through 6.

The foregoing five paragraphs are directed to the conceptual relationship between FIGS. 8 and 9. A more practical presentation of assembly procedures leading to the flattened configuration of FIG. 4 may also be helpful.

The sheet stock should first be printed by a silkscreen or direct-printing process, and then die-cut, scored and perforated from the "inside." After that, glue is applied to the tab 13 on the inside of the sheet, and then the blank is folded over along the right edge 8 of the rear panel 7-16-17-25-31-32 to glue the tap 13 to the left side panel 5.

Next, glue is applied to the right side panel 1 in a stripe along its rear edge 33. Finally, the blank is folded along the corner 4 between the left-side panel 5 and the front-and-seat panel 3–24, to secure the right side panel 1 to the outside of the intermediate strip 9.

We prefer to have the blank shown in FIG. 8 made from double-wall corrugated fiberboard with a Mullen test of 275 to 360 pounds per square inch bursting strength or liner-weight combination of 110 to 126 pounds per thousand square feet. It is further our preference to specify B-type medium fluting toward the outside of the glued tube, and to specify C-type fluting toward the inside of the tube.

Of course the dimensions of the preferred embodiment of our invention will vary with the sizes of people to be accommodated. In mass production for use by the general population, however, we prefer the following:

overall height of the blank (that is to say, length of edge 33, and of fold lines 2, 4, 6 and 8), 71.1 centimeters (28 inches);

width of the chair (that is, the fold-centerline-to-fold-centerline length of fold lines 22, 16 and 15), 43.2 centimeters (17 inches);

front-to-back depth of the chair (that is, the fold-centerline-to-fold-centerline width of panels 1 and 5), 28.4 centimeters (113/16 inches);

height of the seat above a support surface (that is, the fold-centerline-to-cut-edge length of that portion of the fold lines 2 and 4 that is below the fold line 22; or the height of the bottom portion 3 of the front panel) 43.2 centimeters (17 inches); and width of the glue tab 13 (cut-edge-to-fold-centerline), 4.6 centimeters (113/16 inches), but dependent upon the type of glue (or of course other securing means) employed.

The width of the intermediate strip 9 and of the front-to-back length (when horizontal) of the extension 14 can be adjusted between rather liberal limits. Very generally speaking, the "fifth panel" 11 should be midway between the front and rear panels 3 and 7.

Within this very broad constraint, however, we strongly prefer to select these two dimensions so that the "fifth panel" 11 is somewhat closer to the rear panel 7. The reason for this preference is that in typical or normal use the user's torso and hence the greater fraction of applied weight are placed behind the front-to-back central plane of the chair. We thus prefer to make the intermediate strip 9 approximately 13.3 centimeters (5¼ inches).

As mentioned above, we have recently developed certain refinements in the details of the stiffening-angle tab which permit optimization of a tradeoff between structural stabilization and user comfort. A portion of our invention lies in our having recognized that in this type of chair it possible to have too much stability, and that such excess stability in fact degrades the comfort of users.

This recognition is particularly important in regard to protracted use, as for example at sporting events that continue for more than two or three hours. Our refinements make use of this recognition at a critical site in the structure of our chair -- namely, along the line of seat support by the vertical "fifth panel."

Here, we have found, it is possible to introduce a structural feature that moderates the stiffening action provided by the stiffening-angle tab. The amount of this moderating can be quantitatively controlled by selection of the precise dimensions of this feature, so that by trial and error it is possible to optimize the comfort of a user of specified dimensions and weight.

This optimization can simply be performed for a typical adult user. If preferred, however, for users of a variety of heights and weights a corresponding variety of optimal dimensions can be worked out. Blanks for making our chairs with a variety of dimensions can be prepared for use by different groups of people, when it is feasible to determine in advance the sizes and weights of people who will be using the chairs.

Figure 11:
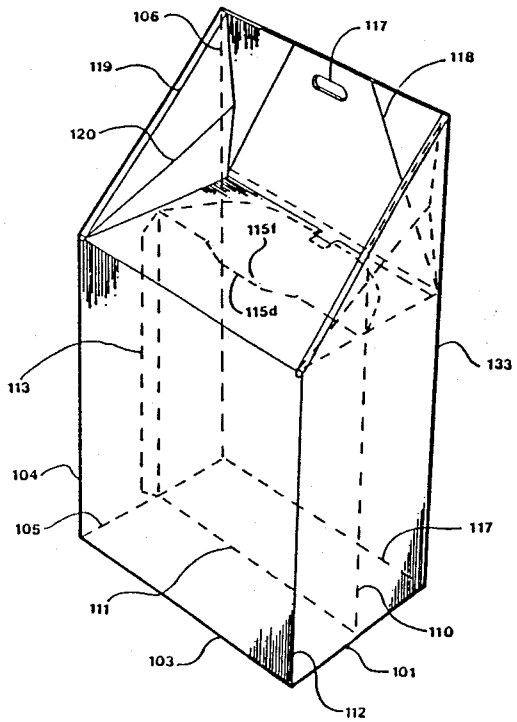
FIG. 11 is a "transparent" view similar to that of FIG. 9, but showing the FIG. 10 embodiment that includes the stiffening-tab refinements.
Figure 10:
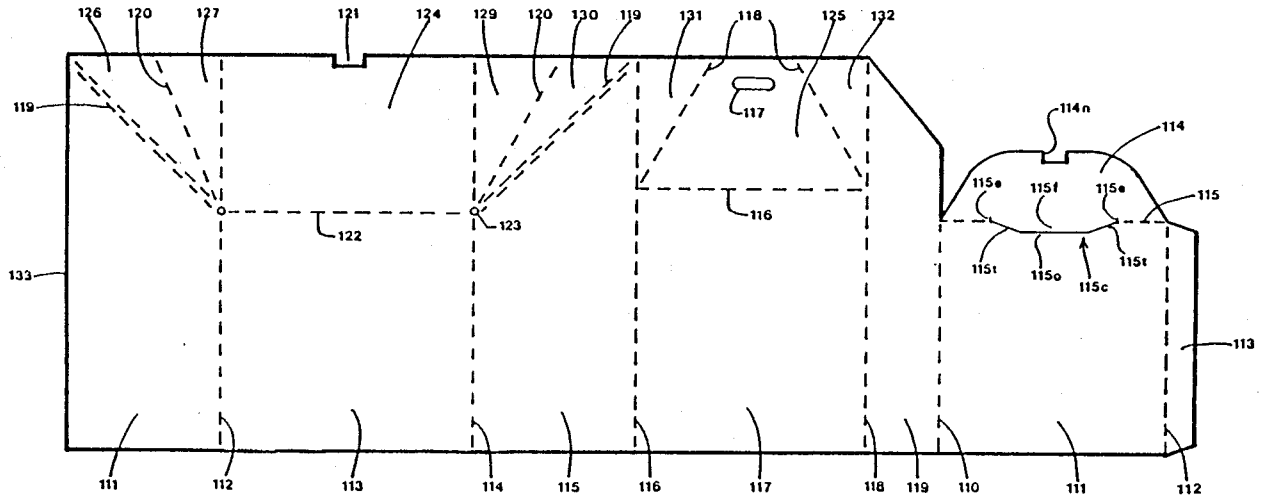
FIG. 10 is a drawing very similar to that of FIG. 8, but showing another embodiment of our invention -- in particular one that includes the stiffening-tab offset-cut refinements discussed above.

The refinements here under discussion, illustrated in FIGS. 10 and 11, include:

(1) increasing the height of the stiffening-angle tab 114 so that when folded horizontal it just contacts the rear wall panel 107 -- as does the folded-down seat panel 124;

(2) adding at the tip of the stiffening-angle tab 114 a notch **114*n*, which when the chair is assembled will be aligned generally with the notch 121 in the edge of the seat panel 124; and (3) providing a through-cut 115*c* that is shaped to have a relatively long segment 115*o* which is offset from the geometric extension of the fold line 115**.

In FIGS. 10 and 11, but for the refinements here under discussion, the features illustrated are substantially the same as in the previously discussed drawings. For convenience of reference, the reference numerals used in FIGS. 10 and 11 are the same as in the other illustrations with the addition of a one-hundred series prefix "1".

The through-cut **115*c* advantageously can be formed with two short end segments 115*e*, relatively sharply angled to the fold line 115, that substantially connect the through-cut cut 115*c* to the fold line 115. The through-cut 115*c* if preferred can be instead tapered back to the fold line 115**.

The configuration of the cut which we prefer is a hybrid of these two possibilities -- a five-segment path. A central segment 115o parallels the fold line 115, two very short end segments 115e are perpendicular to the fold line 115, and two intermediate very shallowly tapered segments 115t connect the short end segments 115e with the central segment 115o.

It is not absolutely necessary that the connection of the through-cut 115c to the fold 115 be completed by die-cutting; reliance can instead be placed on a very slight amount of tearing or buckling to complete this connection. We prefer, however, to control the manner and location of this connection by die-cutting the through-cut back to the fold line.

As can be seen from the drawings, when the seat is folded for use the offset through-cut creates a short forward horizontal extension 115f of the horizontal panel 114, and a shallow declivity or cavity 115d in the top of the associated vertical panel 111. The user's weight is supported in part on the combined horizontal surface 115f–114 of the fifth panel. This combined horizontal surface spans the declivity or cavity 115d.

In use the user's weight deforms the seat panel 124 and the combined horizontal surface 115f–114. In this deformation the user's weight presses the combined horizontal surface 115f–114 partly or completely (depending upon the user's weight and dimensions) downward into the declivity 115d.

To some extent—particularly for users of medium or greater size and weight—the chair by this deformation conforms to the user's shape, which promotes the user's comfort. To some extent—particularly for smaller and lighter users—the combined horizontal surface does not "bottom out" in the declivity 115d and thus instead retains some springiness, which likewise promotes the user's comfort.

The previously mentioned five-segment cut configuration causes the declivity in the vertical portion 111 of the fifth panel to be gently tapered for comfortable conformance to the body of a middle-size, middle-weight user, but still provides a small vertical drop at each end of the declivity to create a springy "span" effect for smaller, lighter users.

While we offer some analysis of a theory by which our invention may work, observation of the deformation of the chair in use is difficult or impossible. The invention does not depend on the accuracy of such analysis or theory.

The dimensions of the form of our invention shown in FIGS. 10 and 11 are generally the same as already presented for the form of the invention previously discussed. One exception is in the front-to-back length (when horizontal) of the extension 114 -- which as will now be clear should be approximately 13 to 13.3 centimeters (5 to 5¼ inches) to roughly match the intermediate strip 109.

For adults in a normal range of size and weight, we prefer to make the length of the offset cut 115c approximately 23 centimeters (9 inches), and the maximum offset roughly 1.8 centimeters (11/16 inch). The finger notch 121 in the back panel can be approximately 4.4 centimeters (13/4 inches) wide, and the corresponding notch 114n in the stiffening-angle tab 114 can be approximately 5.7 centimeters (21/4 inches) wide. Both notches can be approximately 1.9 centimeters (¾ inch) deep.

It is possible to adjust the chair design for users' size and weight. In very general terms, depending upon the effects desired, we believe that both the length of the offset cut 115c and the maximum offset distance (the distance from the offset segment 115o of the cut and the extension of the fold line 115) may be progressively decreased for relatively larger, heavier people.

We are not theoreticians, but it seems that such users tend to create slight deformation of the structure for themselves, without the need for a built-in stiffening-moderation (or "weakening") feature. For such people it is accordingly preferable to trade away some comfort-producing potential, to gain greater stability of support.

The foregoing disclosure is intended to be merely exemplary, not to limit the scope of the invention -- which is to be determined by reference to the appended claims.

We claim:

1. A disposable chair that in a few seconds can be folded substantially flat for storage and shipment or unfolded and configured for use; said chair comprising:

four substantially contiguous and substantially rectangular panels of material that is of generally planar character, extended in only two dimensions and substantially very thin in a third dimension but sufficiently stiff and strong in the aggregate, when configured for use, to support a person; said four rectangular panels defining generally vertical edges of substantially equal length, which length is the overall height of the chair;

one pair of the four rectangular panels being mutually of substantially equal width, which is substantially the width of the chair when in use; one of the pair forming the back of the chair, and the other of the pair having portions that respectively form the front and seat of the chair;

another pair of the four rectangular panels being mutually of substantially equal width, which is substantially the front-to-back depth of the chair when in use; each of this other pair forming one of the sides of the chair;

said four rectangular panels being joined along substantially the entire lengths of their equal-length edges, the side panels alternating with the front and back panels to form an upstanding tube of substantially rectangular plan;

a fifth rectangular panel that is disposed erect within the tube, and that;

defines two vertical edges and a horizontal upper edge, is joined along its two vertical edges to the two side panels, respectively, is parallel and nearly equal in width to the front and back of the chair, and is also of generally planar material that is sufficiently stiff and strong to significantly aid in supporting, and in distributing to the other four panels for support thereby, the weight of a person;

the seat-forming portion of the panel that forms the front and seat of the chair being folded downwardly and inwardly, with respect to the tube, against the back of the chair to be supported by the horizontal upper edge of the fifth panel;

each side panel being doubled over and inwardly, with respect to the tube, along a line extending generally from the top rear corner downward and forward to intersect the fold in the panel that forms the front and seat; and upper portions of the side panels being adapted for folding along additional intermediate angled lines, to permit buckling deformation of the tube out of rectangular plan and thereby to facilitate folding of said seat-forming portion upward and outward relative to the tube for shipment and storage, or downward and inward relative to the tube for use;

wherein the height of the fifth panel defines the height of the seat panel above the bottom of the chair, and very generally equals the difference between the overall height of the chair and said front-to-back depth of the chair; and further comprising an intermediate generally planar vertical strip interconnecting one vertical edge of the fifth panel with a vertical edge of a first one of the side panels;

said strip standing parallel to and in generally planar contact with said first one of the side panels and being of a width that is very generally half the front-to-back depth of the chair;

further comprising a generally vertical tab, unitary with the other vertical edge of the fifth panel, that secures said other vertical edge to a second one of the side panels, which is opposite the intermediate strip;

all of said five panels, the intermediate strip and the vertical tab being formed of a single unitary blank, one of the four first-mentioned rectangular panels being at one end of the blank and the tab being at the other end of the blank; and the panel that is at one end of the blank being secured to the intermediate strip; and further comprising a stiffening-angle tab joined to the fifth panel along the horizontal upper edge of that panel, and folded backward and downward toward a generally horizontal orientation;

wherein the fifth panel and the stiffening-angle tab are unitary and are mutually demarcated by, in part, a transverse score along which they are mutually folded and by, in part, a generally transverse through-cut;

wherein the through-cut interrupts a segment of the score, and is at least in part offset from a projection of the score through that interrupted segment; and wherein the offset through-cut causes part of the fifth panel below the projection of the score through said interrupted segment to function as a part of the stiffening-angle tab and to be folded toward a generally horizontal orientation together with the rest of the stiffening-angle tab.

2. The chair of claim 1, wherein: said part of the fifth panel below the projection of the score through said interrupted segment, being folded toward a generally horizontal orientation, leaves a declivity in an upper vertical edge of the fifth panel below the generally horizontal part of the fifth panel; and said declivity and said generally horizontal part of the fifth panel cooperate to enhance such person's comfort.

3. The chair of claim 1:

all of said five panels having cut horizontal bottom edges, defined by a substantially continuous and colinear cut edge of the blank, for resting directly on pavement or grass or the like supporting surface; and upper portions of the rear panel having intermediate angled fold lines to permit buckling deformation.

4. The chair of claim 3, further comprising:

a hand-access cutout defined in the top edge of the seat-forming portion, to facilitate grasping and folding of the seat-forming portion upward and away from the back of the chair.

5. A method for using the chair of claim 4, comprising the steps of:

providing the chair configured for use in supporting a person on the seat-forming portion thereof;

after such use is completed and such person no longer occupies the chair, inserting a hand from above through the hand-access cutout of the seat-forming portion;

then grasping the seat-forming portion through the cutout, and lifting it away from the back of the chair;

generally simultaneously with said grasping and lifting step, deforming the upper portions of the four first-mentioned rectangular panels by buckling the sides outward, relative to the tube;

continuing the motion of the seat-forming portion upward and forward until the seat-forming portion is generally vertical;

then folding the tube from its rectangular plan condition to its generally flat condition; and;

then shipping the folded chair as a flat tube to a subsequent point of use, storage or disposal.

6. The chair of claim 3, wherein:

the blank consists of double-wall corrugated fiberboard with a Mullen test of 275 to 350 pounds per square inch bursting strength or liner-weight combination of 110 to 126 pounds per thousand square feet, and with B-type medium fluting toward the outside of the tube and C-type fluting toward the inside of the tube.

7. A method for using the disposable fiberboard chair of claim 6, comprising the steps of:

shipping the diecut, scored, folded and secured blank as a flat tube to a point of use;

then unfolding the tube to its rectangular plan condition;

then pushing the stiffening-angle tab backward and downward toward a generally horizontal orientation;

then deforming the upper portions of the four first-mentioned rectangular panels by buckling the sides at the intermediate angled lines outward, relative to the tube;

then pushing the seat-forming portion backward, inward relative to the tube, and downward against the back of the chair, to rest on the upper edge of the fifth panel and on the stiffening-angle tab; and then providing the blank for use in supporting a person on the seat-forming portion thereof.

8. A method for using the disposable chair of claim 3, comprising the steps of:

shipping the folded and secured blank as a flat tube to a point of use;

then unfolding the tube to its rectangular plan condition;

then deforming the upper portions of the four first-mentioned rectangular panels by buckling the sides at the intermediate angled lines outward, relative to the tube;

then pushing the seat-forming portion backward, inward relative to the tube, and downward against the back of the chair, to be supported by the upper edge of the fifth panel; and then providing the chair for use in supporting a person on the seat-forming portion thereof.

9. The chair of claim 1, wherein:

the blank consists of a double-wall corrugated fiberboard with a Mullen test of 275 to 350 pounds per square inch bursting strength or liner-weight combination of 110 to 126 pounds per thousand square feet, and with B-type medium fluting toward the outside of the tube and C-type fluting toward the inside of the tube.

10. A method for using the disposable fiberboard chair of claim 9, comprising the steps of:

shipping the diecut, scored, folded and secured blank as a flat tube to a point of use;

then unfolding the tube to its rectangular plan condition;

then pushing the stiffening-angle tab backward and downward toward a generally horizontal orientation;

then deforming the upper portions of the four first-mentioned rectangular panels by buckling the sides at the intermediate angled lines outward, relative to the tube;

then pushing the seat-forming portion backward, inward relative to the tube, and downward against the back of the chair, to rest on the upper edge of the fifth panel and on the stiffening-angle tab; and then providing the blank for use in supporting a person on the seat-forming portion thereof.

11. A method for using the disposable chair of claim 1, comprising the step of:

shipping the diecut, scored, folded and secured blank as a flat tube to a point of use;

then unfolding the tube to its rectangular plan condition;

then pushing the stiffening-angle tab backward and downward toward a generally horizontal orientation;

then deforming the upper portions of the four first-mentioned rectangular panels by buckling the sides at the intermediate angled lines outward, relative to the tube;

then pushing the seat-forming portion backward, inward relative to the tube, and downward against the back of the chair, to rest on the upper edge of the fifth panel and on the stiffening-angle tab; and then providing the blank for use in supporting a person on the seat-forming portion thereof.

12. The chair of claim 1, further comprising:

a hand-access cutout defined in the top edge of the seat-forming portion, to facilitate grasping and folding of the seat-forming portion upward and away from the back of the chair.

13. A method for using the chair of claim 12, comprising the steps of:

providing the chair configured for use in supporting a person on the seat-forming portion thereof;

after such use is completed and such person no longer occupies the chair, inserting a hand from above through the hand-access cutout of the seat-forming portion;

then grasping the seat-forming portion through the cutout, and lifting it away from the back of the chair;

generally simultaneously with said grasping and lifting step, deforming the upper portions of the four first-mentioned rectangular panels by buckling the sides outward, relative to the tube;

generally simultaneously with said grasping and lifting step, reaching through the cutout to help start the outer edge of the stiffening-angle tab upward and forward away from its horizontal orientation;

continuing the motions of the seat-forming portion and of the stiffening-angle tab upward and forward until the seat-forming portion and the stiffening-angle tab are generally vertical;

then folding the tube from its rectangular plan condition to its generally flat condition; and;

then shipping the folded chair as a flat tube to a subsequent point of use, storage or disposal.

14. A disposable chair that in a few seconds can be folded substantially flat for storage and shipment or unfolded and configured for use; said chair comprising:

four substantially contiguous and substantially rectangular panels of material that is of generally planar character, extended in only two dimensions and substantially very thin in a third dimension but sufficiently stiff and strong in the aggregate, when configured for use, to support a person; said four rectangular panels defining generally vertical edges of substantially equal length, which length is the overall height of the chair;

one pair of the four rectangular panels being mutually of substantially equal width, which is substantially the width of the chair when in use; one of the pair forming the back of the chair, and the other of the pair having portions that respectively form the front and seat of the chair;

another pair of the four rectangular panels being mutually of substantially equal width, which is substantially the front-to-back depth of the chair when in use; each of this other pair forming one of the sides of the chair;

said four rectangular panels being joined along substantially the entire lengths of their equal-length edges, the side panels alternating with the front and back panels to form an upstanding tube of substantially rectangular plan;

a fifth rectangular panel that is disposed erect within the tube, and that:

defines two vertical edges and a horizontal upper edge, is joined along its two vertical edges to one or the other pair of rectangular panels, is parallel and nearly equal in width to the remaining pair of rectangular panels, and is also of generally planar material that is sufficiently stiff and strong to significantly aid in supporting, and in distributing to the other four panels for support thereby, the weight of a person;

the seat-forming portion of the panel that forms the front and seat of the chair being folded downwardly and inwardly, with respect to the tube, against the back of the chair to be supported by the horizontal upper edge of the fifth panel;

each side panel being doubled over and inwardly, with respect to the tube, along a line extending generally from the top rear corner downward and forward to generally intersect the fold in the panel that forms the front and seat;

wherein the height of the fifth panel defines the height of the seat panel above the bottom of the chair, and very generally equals the difference between the overall height of the chair and said front-to-back depth of the chair; and further comprising an intermediate generally planar vertical strip interconnecting one vertical edge of the fifth panel with a vertical edge of one of the other four panels;

said strip standing parallel to and in generally planar contact with some one of the other four panels and being of a width that is very generally half the width or depth of the chair;

further comprising a generally vertical tab, unitary with the other vertical edge of the fifth panel, that secures said other vertical edge to a rectangular panel which is opposite the intermediate strip;

all of said five panels, the intermediate strip and the vertical tab being formed on a single unitary blank, one of the four first-mentioned rectangular panels being at one end of the blank and the tab being at the other end of the blank; and the panel that is at one end of the blank being secured to the intermediate strip; and further comprising a stiffening-angle tab joined to the fifth panel along the horizontal upper edge of that panel, and folded downward toward a generally horizontal orientation;

wherein the fifth panel and the stiffening-angle tab are unitary and are mutually demarcated by, in part, a transverse score along which they are mutually folded and by, in part, a generally transverse through-cut;

wherein the through-cut interrupts a segment of the score, and is at least in part offset from a projection of the score through that interrupted segment; and wherein the offset through-cut causes part of the fifth panel below the projection of the score through said interrupted segment to function as a part of the stiffening-angle tab and to be folded toward a generally horizontal orientation together with the rest of the stiffening-angle tab.

15. The chair of claim 14, wherein:

upper portions of the side panels having additional intermediate angled fold lines, to permit buckling deformation of the tube out of rectangular plan and thereby to facilitate folding of said seat-forming portion upward and outward relative to the tube for shipment and storage, or downward and inward relative to the tube for use.

16. The chair of claim 14, wherein:

the fifth panel stands parallel to the front and back of the chair;

the vertical tab joins the fifth panel to one side of the chair; and the intermediate strip is parallel to and in generally planar contact with the opposite side of the chair.

17. A disposable chair that in a few seconds can be folded substantially flat for storage and shipment or unfolded and configured for use; said chair comprising:

four substantially contiguous and substantially rectangular panels of material that is of generally planar character, extended in only two dimensions and substantially very thin in a third dimension but sufficiently stiff and strong in the aggregate, when configured for use, to support a person; said four rectangular panels defining generally vertical edges of substantially equal length, which length is the overall height of the chair;

one pair of the four rectangular panels being mutually of substantially equal width, which is substantially the width of the chair when in use; one of the pair forming the back of the chair, and the other of the pair having portions that respectively form the front and seat of the chair;

another pair of the four rectangular panels being mutually of substantially equal width, which is substantially the front-to-back depth of the chair when in use; each of this other pair forming one of the sides of the chair;

said four rectangular panels being joined along substantially the entire lengths of their equal-length edges, the side panels alternating with the front and back panels to form an upstanding tube of substantially rectangular plan;

a fifth rectangular panel that is disposed erect within the tube, and that;

defines two vertical edges and a horizontal upper edge, is joined along its two vertical edges to one or the other pair of rectangular panels, is parallel and nearly equal in width to the remaining pair of rectangular panels, and is also of generally planar material that is sufficiently stiff and strong to significantly aid in supporting, and in distributing to the other four panels for support thereby, the weight of a person;

the seat-forming portion of the panel that forms the front and seat of the chair being folded downwardly and inwardly, with respect to the tube, against the back of the chair to be supported by the horizontal upper edge of the fifth panel;

each side panel being doubled over and inwardly, with respect to the tube, along a line extending generally from the top rear corner downward and forward to generally intersect the fold in the panel that forms the front and seat;

wherein the height of the fifth panel defines the height of the seat panel above the bottom of the chair, and very generally equals the difference between the overall height of the chair and said front-to-back depth of the chair; and further comprising an intermediate generally planar vertical strip interconnecting one vertical edge of the fifth panel with a vertical edge of one of the other four panels;

said strip standing parallel to and in generally planar contact with some one of the other four panels and being of a width that is very generally half the width or depth of the chair;

further comprising a generally vertical tab, unitary with the other vertical edge of the fifth panel, that secures said other vertical edge to a rectangular panel which is opposite the intermediate strip;

all of said five panels, the intermediate strip and the vertical tab being formed of a single unitary blank, one of the four first-mentioned rectangular panels being at one end of the blank and the tab being at the other end of the blank; and the panel that is at one end of the blank being secured to the intermediate strip; and further comprising a stiffening-angle tab joined to the fifth panel along the horizontal upper edge of that panel, and folded downward toward a generally horizontal orientation.

18. The chair of claim 17, wherein:

upper portions of the side panels are adapted for folding along additional intermediate angled lines, to permit buckling deformation of the tube out of rectangular plan and thereby to facilitate folding of said seat-forming portion upward and outward relative to the tube for shipment and storage, or downward and inward relative to the tube for use.

19. The chair of claim 17, wherein:

the fifth panel stands parallel to the front and back of the chair;

the vertical tab joins the fifth panel to one side of the chair; and the intermediate strip is parallel to and in generally planar contact with the opposite side of the chair.

* * * * *